US009543085B2

(12) United States Patent
Holland et al.

(10) Patent No.: US 9,543,085 B2
(45) Date of Patent: Jan. 10, 2017

(54) NON-FUSIBLE SWITCH ASSEMBLIES, LINE BASE ASSEMBLIES, LOAD BUS CONNECTOR ASSEMBLIES, AND OPERATIONAL METHODS

(71) Applicant: Siemens Industry, Inc., Alpharetta, GA (US)

(72) Inventors: Michael J. Holland, Hilliard, OH (US); Thomas Jameson, Bellefontaine, OH (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 231 days.

(21) Appl. No.: 14/484,577

(22) Filed: Sep. 12, 2014

(65) Prior Publication Data

US 2016/0079008 A1 Mar. 17, 2016

(51) Int. Cl.

| | |
|---|---|
| ***H01H 71/08*** | (2006.01) |
| ***H01H 9/36*** | (2006.01) |
| ***H01H 1/36*** | (2006.01) |
| *H01H 9/34* | (2006.01) |
| *H01H 1/42* | (2006.01) |
| *H01H 31/28* | (2006.01) |

(52) U.S. Cl.

CPC ..... *H01H 9/36* (2013.01); *H01H 1/365* (2013.01); *H01H 1/42* (2013.01); *H01H 9/34* (2013.01); *H01H 71/08* (2013.01); *H01H 2031/286* (2013.01)

(58) Field of Classification Search

CPC ..... H01H 1/36; H01H 9/34; H01H 9/10; H01H 11/0006

USPC .... 200/293, 15, 554, 290; 218/153; 335/202

See application file for complete search history.

(56) References Cited

U.S. PATENT DOCUMENTS

| | | | | |
|---|---|---|---|---|
| 4,809,132 A * | 2/1989 | Palmieri | ..... | H01H 71/08 335/202 |
| 5,990,439 A * | 11/1999 | Pever | ..... | H01H 33/022 218/155 |
| 2008/0246566 A1* | 10/2008 | Oh | ..... | H01H 71/08 335/197 |

OTHER PUBLICATIONS

Power Product Safety & Disconnect Switches. Siemens Canada Limited Power Product Catalogue. Jan. 25, 2013. (54 pages).

* cited by examiner

*Primary Examiner* — Renee Luebke
*Assistant Examiner* — Ahmed Saeed

(57) ABSTRACT

A non-fusible switch assembly including a line base assembly is disclosed. Line base assembly includes a load bus connector assembly with single-piece lug body, first and second load lugs formed in the lug body, and load-side sliding nuts slidably received in first and second load-side slide features, and load-side stationary contacts positioned directly underneath of the first and second load lugs within a projected footprint of the lug body. Line base assemblies, load lug connector assemblies and methods of operating a line base assembly are provided, as are other aspects.

12 Claims, 10 Drawing Sheets

NON-FUSIBLE SWITCH ASSEMBLIES, LINE BASE ASSEMBLIES, LOAD BUS CONNECTOR ASSEMBLIES, AND OPERATIONAL METHODS

FIELD

The invention relates generally to non-fusible switch assemblies, line base assemblies and subcomponents thereof.

BACKGROUND

Conventional non-fusible switch assemblies include a line base assembly within an enclosure, such as a metal switch box. Prior art non-fused switch assemblies include a line base assembly including lugs adapted to allow connection to line and load conductor wires, and a rotor assembly operable with a rotation mechanism to open or close the switch thereof. Multiple poles, such as 3-pole, non-fusible switch assemblies are commonplace.

The rotor assembly of the non-fusible switch includes multiple blades adapted to electrically couple to stationary contacts when the rotation mechanism rotates the rotor assembly.

Such non-fusible switch assemblies, although adequate for their intended purposes, tend to have long lengths, thus requiring relatively large enclosures, and may include relatively high material and assembly costs. Furthermore, such non-fusible switch assemblies may include a large number of components. Thus, the non-fusible switches may tend to be costly to manufacture, because of their size and complexity (e.g. number of components).

Therefore, a need exists to reduce the size and complexity of such non-fusible switch assemblies.

SUMMARY

According to a first aspect, a line base assembly is provided. The line base assembly includes a base; a line bus connector assembly coupled to the base, the line bus connector assembly including: a connector body including a first body portion and a second body portion extending from the first body portion and being thinner than first body portion, wherein the connector body is a single piece, first and second line lugs formed in the first body portion, and first and second line slide features formed in the connector body, first and second line-side sliding nuts configured to be received in the first and second line slide features, and line-side stationary contacts coupled to the second body portion; and a load bus connector assembly coupled to the base, the load bus connector assembly including: a lug body including a front side, a back side, and an underside, wherein the lug body is a single piece, first and second load lugs formed in the lug body, and first and second load slide features formed in the lug body, first and second load-side sliding nuts configured to be received in the first and second load slide features, and load-side stationary contacts attached to, and extending downward from, the underside of the lug body, and wherein the load-side stationary contacts are positioned directly underneath of the first and second load lugs within a projected footprint of the lug body.

According to another aspect, a load bus connector assembly is provided. The load bus connector assembly includes a lug body including a front side, a back side, and an underside, wherein the lug body is a single piece, first and second load lugs formed in the lug body, and first and second load slide features formed in the lug body, first and second load-side sliding nuts configured to be received in the first and second load slide features, and load-side stationary contacts attached to, and extending downward from, the underside of the lug body, and wherein the load-side stationary contacts are positioned directly underneath of the first and second load lugs within a projected footprint of the lug body.

According to another aspect, a non-fusible switch assembly is provided. The non-fusible switch assembly includes a line base assembly including: a base; a line bus connector assembly coupled to the base; a load bus connector assembly coupled to the base, the load bus connector assembly including: a lug body including a front side, a back side, and an underside, wherein the lug body is a single piece, first and second load lugs formed in the lug body, and first and second load slide features formed in the lug body, first and second load-side sliding nuts configured to be received in the first and second load slide features, and load-side stationary contacts attached to, and extending downward from, the underside of the lug body, and wherein the load-side stationary contacts are positioned directly underneath of the first and second load lugs within a projected footprint of the lug body; and a rotor assembly including blades adapted to electrically couple to line-side stationary contacts and the load-side stationary contacts.

According to yet another aspect, a method of operating a line base assembly is provided. The method includes providing a line base assembly including a load bus connector assembly, the load bus connector assembly including a single-piece lug body having first and second load lugs formed therein, and load-side stationary contacts attached to, and extending downward from, an underside of the single-piece lug body, wherein the load-side stationary contacts are positioned directly underneath of the first and second load lugs within a projected footprint of the lug body, providing a rotor assembly including load-side blades and line-side blades, and rotating the rotor assembly to engage the load-side blades with the load-side stationary contacts underneath the projected footprint of the lug body.

Still other aspects, features, and advantages of the invention may be readily apparent from the following detailed description wherein a number of exemplary embodiments and implementations are described and illustrated, including the best mode contemplated for carrying out the invention. The invention may also be capable of other and different embodiments, and its several details may be modified in various respects, all without departing from the scope of the invention. Accordingly, the drawings and descriptions are to be regarded as illustrative in nature, and not as restrictive. The drawings are not necessarily drawn to scale. The invention covers all modifications, equivalents, and alternatives falling within the scope of the invention.

DESCRIPTION

Figure 1:
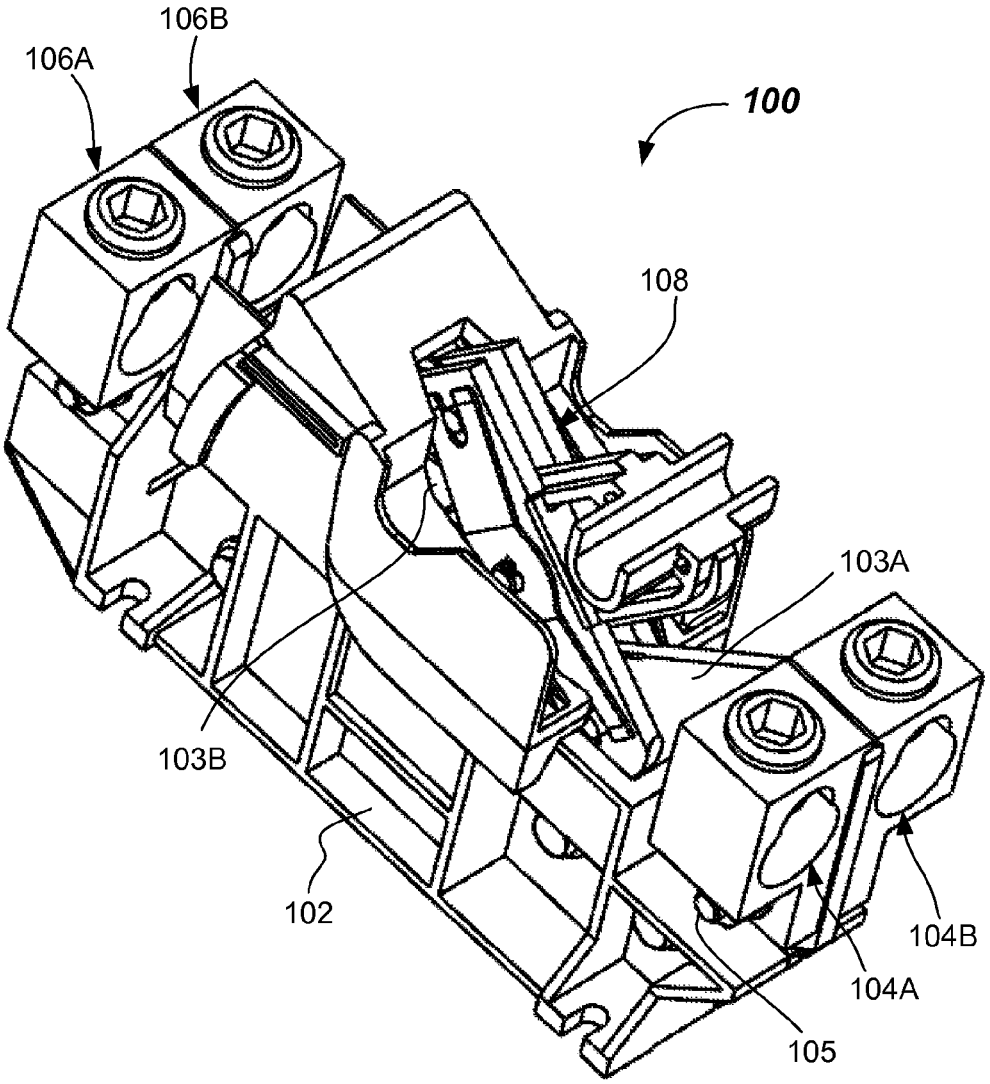
FIG. 1 Prior Art
FIG. 1 illustrates a perspective view of a non-fusible switch assembly according to the prior art.

FIG. 1 illustrates a perspective view of an embodiment of a line base assembly 100 according to the prior art. Line base assembly 100 includes a base 102, a load-side conductive stab 103A, a first load lug assembly 104A attached to a first side of the load-side conductive stab 103A, and a second load lug assembly 104B attached to a second side of the load-side conductive stab 103A, such as by fastener 105. Line base assembly 100 includes a line-side conductive stab 103B, a first line lug assembly 106A attached to the line-side conductive stab 103B, and a second line-side lug assembly 106B attached to the line-side conductive stab 103B. A rotor assembly 108 may be rotatable relative to the base 102 such that blades of the rotor assembly 108 electrically connect with the respective load-side conductive stabs 103A and the line-side conductive stabs 103B. When more than one pole is included in a non-fusible switch assembly, multiple ones of the depicted line base assembly 100 are used and mounted to a switch box in a side-by-side arrangement. However, this structure, although entirely functional, includes many pieces and has a long length.

Reference will now be made in detail to example embodiments of this disclosure, which are illustrated in the accompanying drawings. Wherever possible, the same reference numbers will be used throughout the drawings to refer to the same or like parts.

The aforementioned problem of excessive size and complexity of prior art non-fusible switches is overcome by one or more embodiments of the invention. In particular, non-fusible switch assemblies including line base assemblies are described herein. Subassemblies and components thereof such as line bus connector assemblies and load bus connector assemblies described herein aid in the provision of a compact construction may result in substantially shorter component length, fewer components, and smaller enclosure requirements.

Embodiments of non-fusible switch assemblies, line base assemblies, and components thereof will be explained in greater detail below with reference to FIGS. 2-8 herein.

Line Base Assembly

Figure 2A:
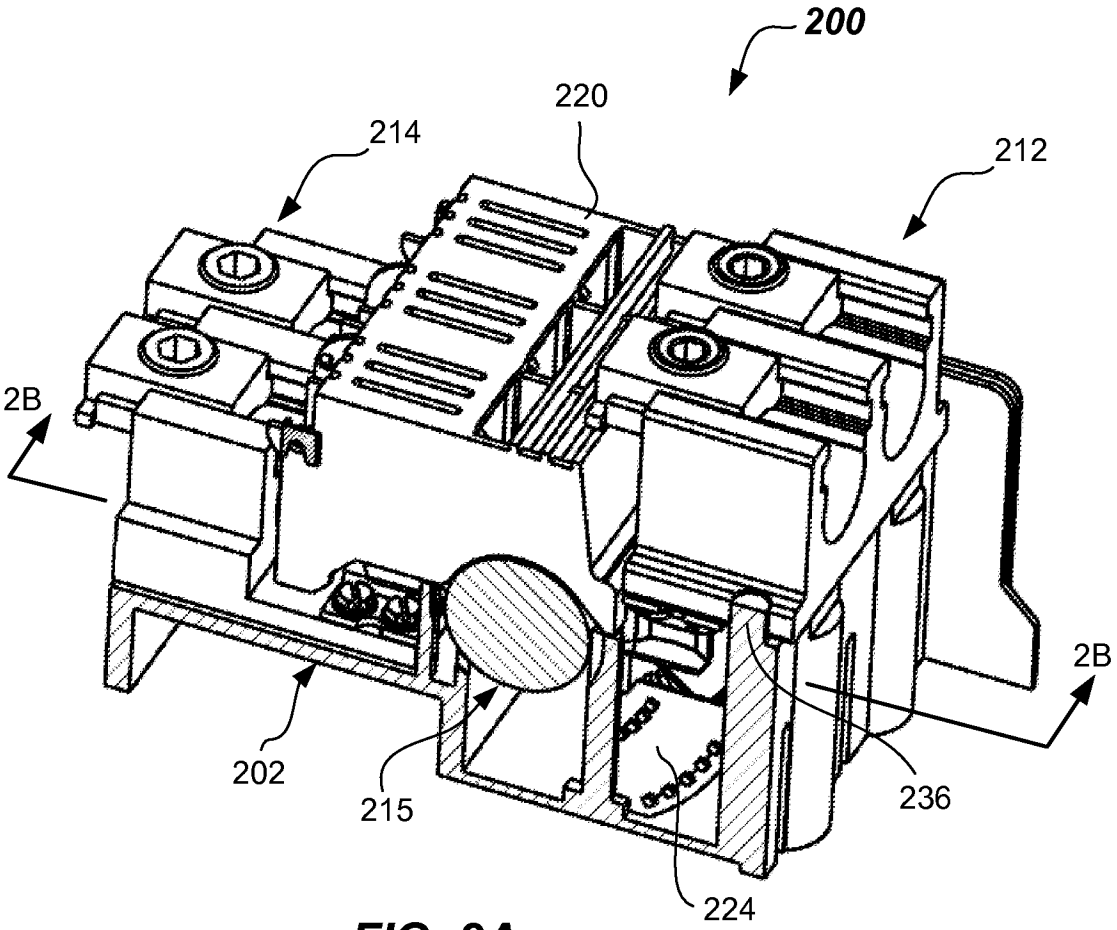
FIG. 2A illustrates a top partial perspective view of a line base assembly of a non-fusible switch assembly according to embodiments.
Figure 2B:
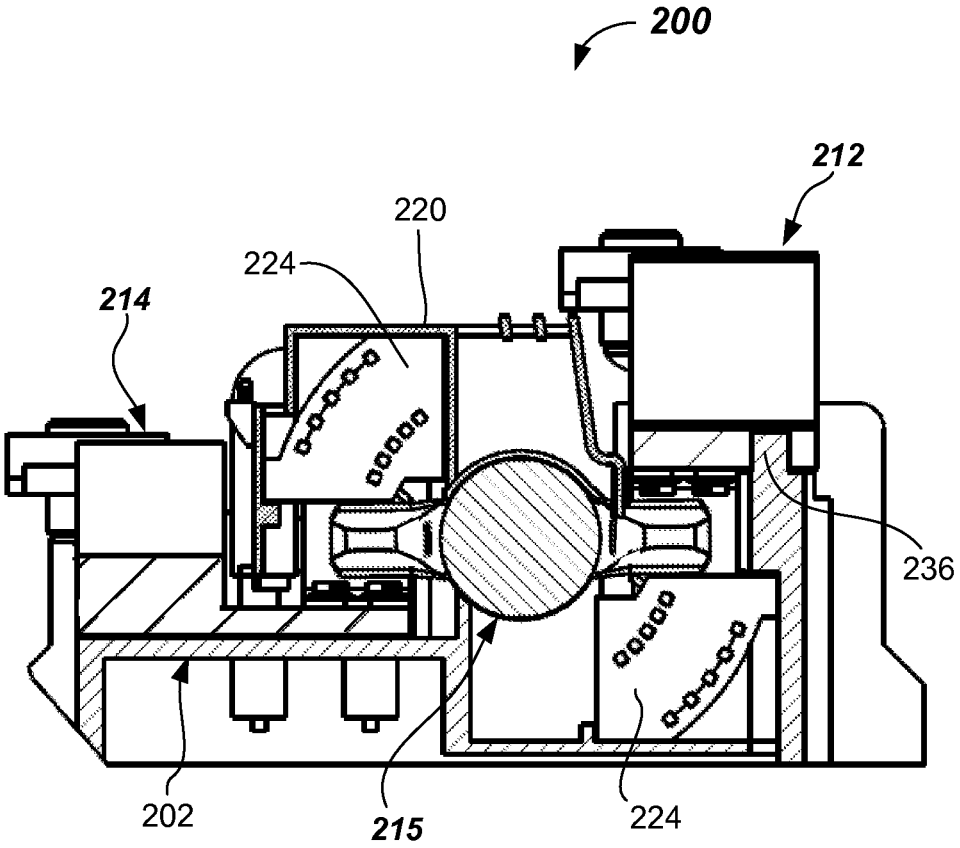
FIG. 2B illustrates a cross-sectioned side view of a line base assembly according to embodiments.

FIGS. 2A and 2B illustrate a perspective and cross-sectioned views, respectively, of a line base assembly 200 in accordance with one or more embodiments of the invention. Line base assembly 200 may be included in a non-fusible switch assembly 500 (see FIG. 5) and is useful to connect electrical power from line-side wire conductors to one or more electrical loads coupled to load-side wire conductors, and also allow on-off power switching in accordance with one or more embodiments of the invention.

Line base assembly 200 includes a base 202, which may be made of any suitable insulating material, for example a polymer insulating material such as a thermoset plastic (e.g., polyester material). The thermoset plastic may be mineral filled, glass-reinforced, or both. Line base assembly 200 may include a load bus connector assembly 212 that may be attached to one end of the base 202, such as by fasteners (e.g., screws, bolts, or the like). Line base assembly 200 may include a line bus connector assembly 214 that may be attached to another end of the base 202 opposite the one end, such as by fasteners (e.g., screws, bolts, or the like).

Line base assembly 200 may also include a rotor assembly 215 (to be described later with reference to FIG. 6) mounted for rotation relative to the base 202 (e.g., in bearing portions thereof) and also for rotation relative to the load bus connector assembly 212 and the line bus connector assembly 214. Other components, such as arc shields 220 and arc grids 224 may be included in the line base assembly 200.

Line base assembly 200 is operational to receive and secure line wire conductors (not shown) at the line bus connector assembly 214 and pass electrical current to the load bus connector assembly 212 through the rotor assembly 215, and also allow electrical disconnection/connection via rotation of the rotor assembly 215, as will be apparent from the following. Two or three of the line base assemblies 200 described with reference to FIGS. 2A and 2B may be included in the non-fusible switch assembly shown in FIG. 5, depending upon the amperage rating of the non-fusible switch assembly 500 and the number of poles included therein.

Figure 5:
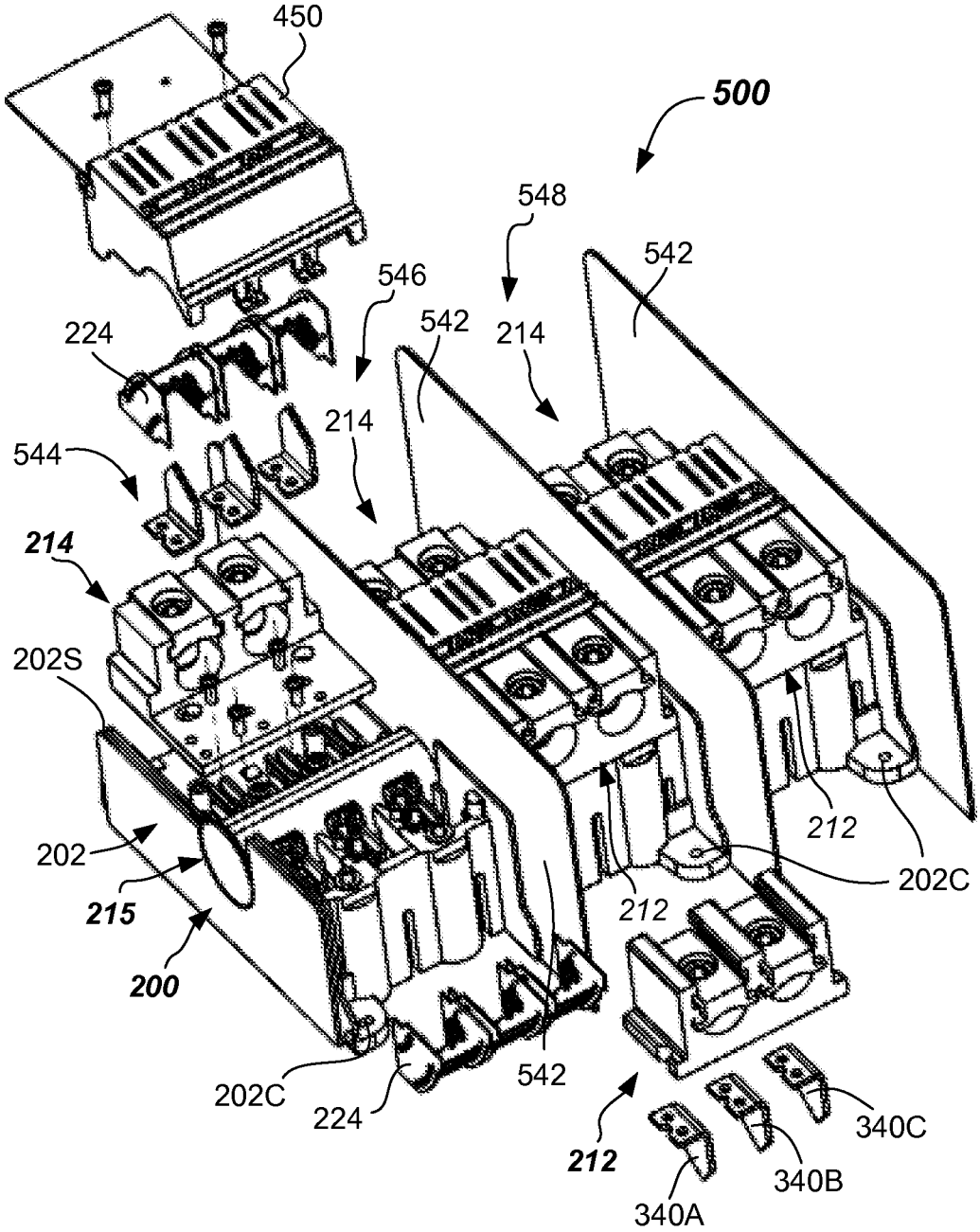
FIG. 5 illustrates a partially-exploded top perspective view of a non-fusible switch assembly according to embodiments.

For example, a 400 Amp, 3-pole non-fusible switch assembly may include 3 poles and a line base assembly 200 per pole. One of the stationary contacts per pole may be inactive (or even not included). A 400 Amp, 2-pole non-fusible switch assembly may include 2 poles and a line base assembly 200 per pole, with one of the stationary contacts being inactive (or even not included). In this version, a base 202 may be used, but the center pole region would be unused. A 600 Amp, 3-pole line base switch assembly (e.g., non-fusible switch assembly 500 as shown in FIG. 5) may include 3 poles and a line base assembly 200 per pole. A 600 Amp, 2-pole line base switch assembly may include 2 poles and a line base assembly 200 per pole. In this version, the base 202 may be used, but the center pole region would be unused.

Load bus connector assemblies 212 may be identical to each other in their construction, as will be described with reference to FIG. 5 herein. In the case of a 3-pole version shown, three pole positions for attachment of load bus connector assemblies 212 are provided. Two load bus connector assemblies 212 may be provided in a 2-pole version, such as at the outer two locations, leaving the center location vacant.

Load Bus Connector Assembly

Figure 3A:
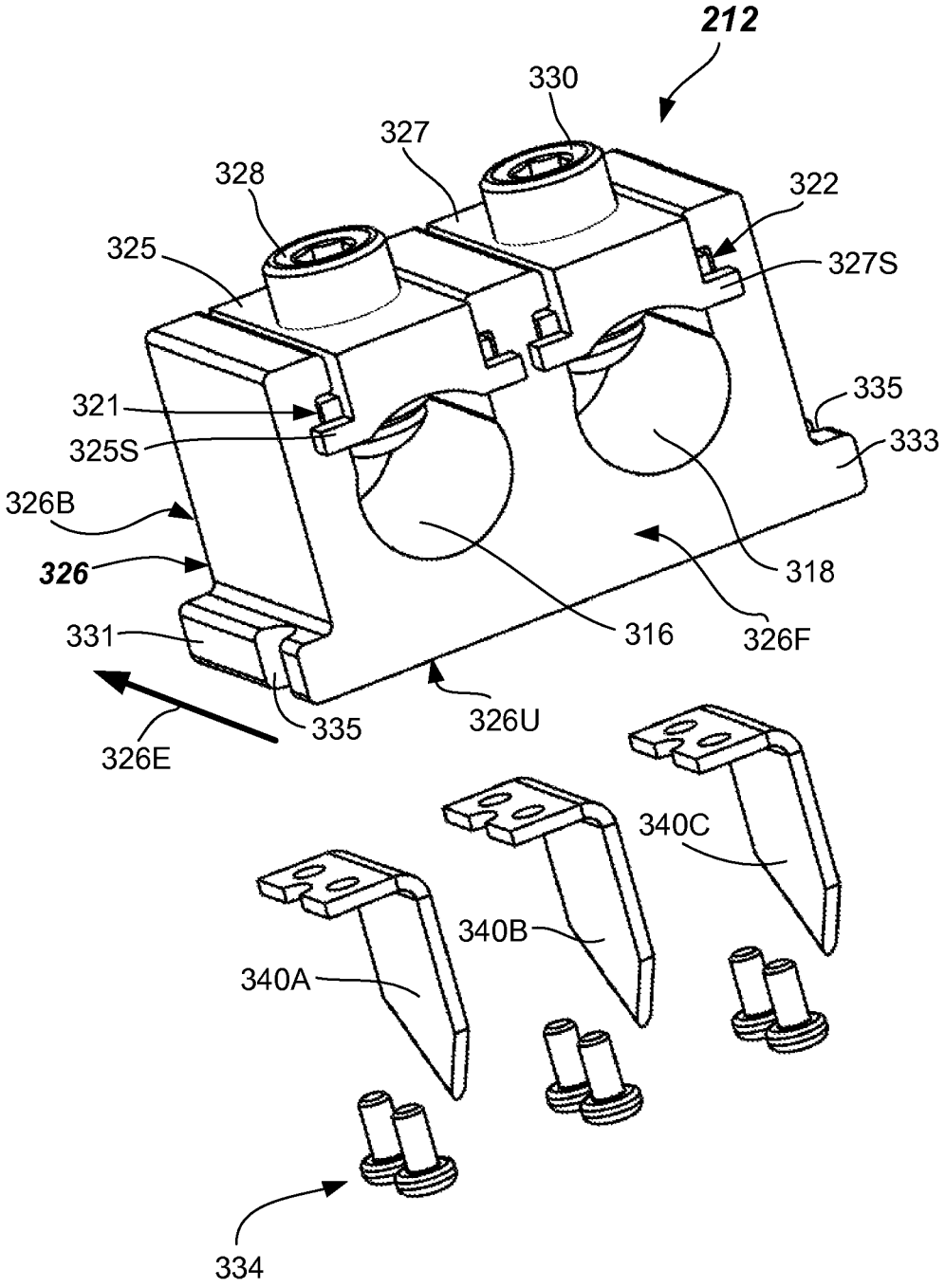
FIG. 3A illustrates a top partially-exploded perspective view of a load bus connector assembly of a non-fusible switch assembly according to embodiments.
Figure 3B:
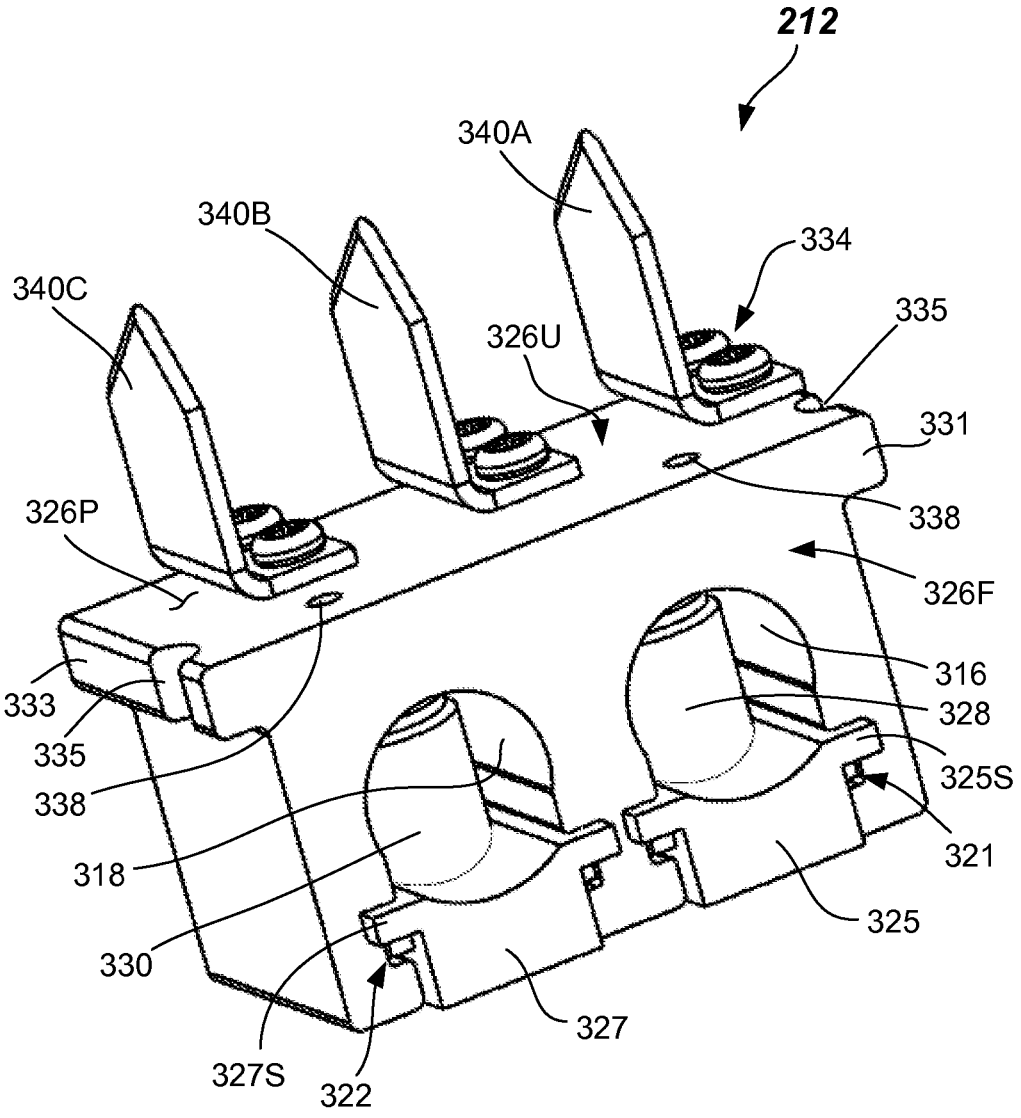
FIG. 3B illustrates a bottom perspective view of a load bus connector assembly of a non-fusible switch assembly according to embodiments.

Now referring to FIGS. 3A-3B, a load bus connector assembly 212 that may be used in the line base assembly 200 is shown as a representative example. Load bus connector assembly 212 may include a lug body 326, which may comprise a single-piece and may be manufactured of an extruded construction. Lug body 326 may be made of a 6061 aluminum alloy material, for example. Other suitably conductive metals may be used. Lug body 326 includes a front side 326F and a back side 326B opposite the front side 326F, and an underside 326U. Lug body 326 may be extruded to form the various length-wise extending features and then machined (e.g., cut) to the desired front-to-back length along the extrusion direction 326E, which is indicated by arrow.

Thus, the front side 326F and the back side 326B may comprise machined planar surfaces. Any suitable machining process (e.g., cutting with a bar cutting machine, water jet cutting, abrasive jet cutting, or the like) may be used to machine the lug body 326 to length.

Load bus connector assembly 212 includes a first lug 316 formed in the lug body 326 that is configured to receive a first load-side electrical wire (not shown). A second lug 318 may also be formed in the lug body 326 and may be configured to receive a second load-side electrical wire (not shown). First lug 316 and second lug 318 (otherwise referred to herein as "first load-side lug" and "second load-side lug") may each be sized and configured to receive a conductor wire having a size between about 1/0 AWG and about 600 kcmil that may be suitable for a 400 A-600 A non-fusible switch assembly, such as non-fusible switch assembly 500 (FIG. 5). First and second lugs 316, 318 may include a semi-circular portion that is of a semi-circular shape in cross-section and is configured and adapted to receive the first and second electrical wires.

First and second slide features 321, 322 (otherwise referred to herein as "first load-side slide feature" and "second load-side slide feature"), which may comprise opposing grooves formed into and extending from the front side 326F to back side 326B in the lug body 326, may be provided above semi-circular portions of each of the first lug 316 and the second lug 318. Grooves may be about 0.13 inch deep (about 3.3 mm deep) and about 0.33 inch (about 8.4 mm thick).

First and second sliding nuts 325, 327 (otherwise referred to herein as "first load-side sliding nut" and "second load-side sliding nut") may be configured to be slidably received in each of the first and second slide features 321, 322, respectively. First and second sliding nuts 325, 327 may include edges that are configured to slide in the first and second slide features 321, 322. Other suitable slide features allowing the first and second sliding nuts 325, 327 to slide may be used.

One end of the first and second sliding nuts 325, 327 may include one or more stops 325S, 327S that interface with and abut the lug body 326 and function to limit an amount of insertion of the first and second sliding nuts 325, 327 into the first and second slide features 321, 322. First and second sliding nuts 325, 327 may each include a threaded bore that receives a first and second wire fastener 328, 330, such as a screw (e.g., hex head set screw) shown. Other suitable wire fasteners may be used.

The lug body 326 may include a first flange 331 and a second flange 333 extending in opposite lateral directions. Registration features 335 may be provided on the first flange 331 and the second flange 333, such as on the terminal lateral ends thereof. Registration features 335 may register with another feature 236 (FIG. 2A), such as a molded feature formed on the base 202. Registration features 335 may be detents, as shown, that may be machined into the first and second flanges 331, 333 after extrusion. Other suitable registration features may be used to locate and align the load bus connector assembly 212 with the base 202. Securing threaded bores 338 may receive fasteners (not shown) through apertures formed in the base 202 to secure the load bus connector assembly 212 to the base 202.

As shown, the underside 326U of the lug body 326 may include a planar surface 326P including threaded bores configured to receive fasteners 334, which may be formed after extrusion. Fasteners 334 and threaded bores may be positioned and configured to attach stationary contacts 340A-340C. Stationary contacts 340A-340C (otherwise referred to herein as "load-side stationary contacts") may be attached to the underside 326U of the lug body 326 by fasteners 334 (e.g., bolts or screws or the like). Other fastening methods may be used. Stationary contacts 340A-340C may be made of a copper material, may be bent in an L-shape, and may include pointed tips thereon, as shown.

The stationary contacts 340A-340C may be attached and positioned in line with the lug body 326, as shown, i.e., connected directly under the first and second lugs 316, 318 and within a projected footprint of the lug body 326 projecting from the underside 326U. The footprint is outlined by the terminal ends of the first and second flanges 331, 333 and the front and back sides 326F, 326B of the lug body 326. Thus, the stationary contacts 340A-340C are all substantially aligned underneath the first and second lugs 316, 318, when viewed from the side (in a direction from first flange 331 to second flange 333). However, the stationary contacts 340A-340C may be positioned to one side or the other of the underside 326U, as shown. Thus, the load bus connector assembly 212 exhibits a shorter front-to-back profile than prior art assemblies, thus shortening the overall length of the line base assembly 200.

Each of the features, such as the first and second lugs 316, 318, first and second slide features 320, 322, first and second flanges 331, 333, underside 326U, as well as the overall outside contour and shape of the lug body may be formed by extrusion along the extrusion direction 326E.

Line Bus Connector Assembly

Figure 4A:
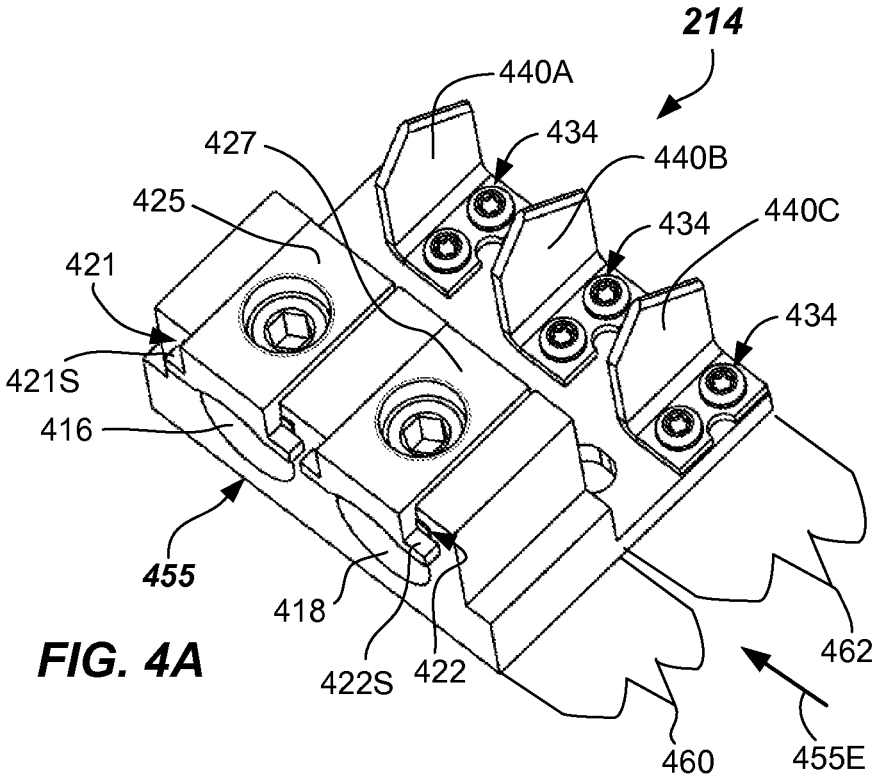
FIGS. 4A and 4B illustrate top and bottom perspective views of a line bus connector assembly of a non-fusible switch assembly according to embodiments.
Figure 4B:
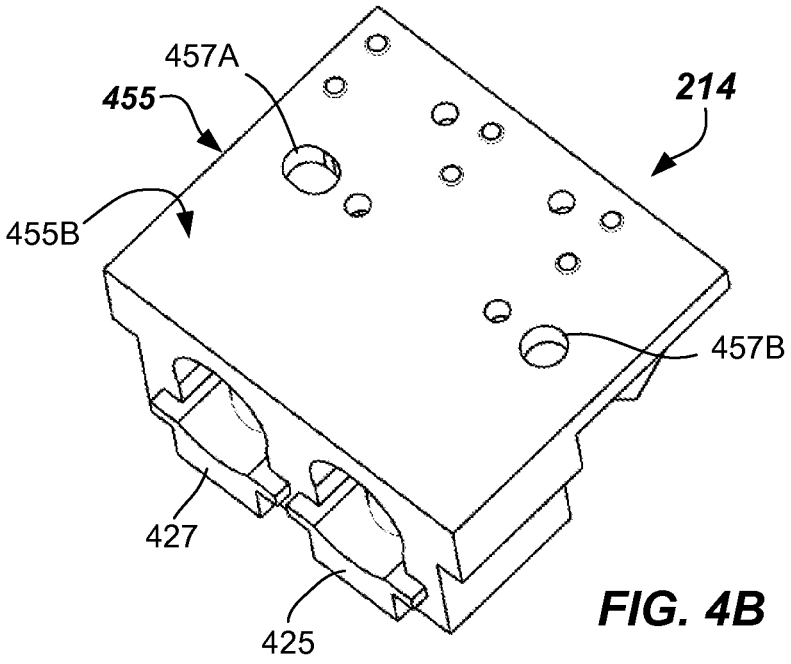

In more detail, and referring to FIGS. 4A-4B, an embodiment of the line bus connector assembly 214 that may be used in the line base assembly 200 is shown. Line bus connector assembly 214 includes a connector body 455, which may be a single piece, and may include an extruded construction. Connector body 455 may be made from a 6061 aluminum alloy, for example. Other conductive metals may be used. Connector body 455 may include a bottom 455B that may be substantially planar and configured to attach to the base 202 of the line base assembly 200. Bosses formed on, and extending from, a surface of the base 202 may serve to register and locate the line bus connector assembly 214 on the base 202, such as by registering in first and second holes 457A, 457B, one of which may be elongated as shown.

First line lug 416 and second line lug 418 may be formed in the connector body 455, and first and second line sliding nuts 425, 427 (otherwise referred to as "first and second line-side sliding nuts") may be slidably received in first and second line slide features 421, 422 (otherwise referred to as "first and second line-side slide features") which may be grooves provided in the connector body 455 above the first and second line lugs 416, 418, as previously described. First and second line lugs 416, 418 may be sized to accept about 1/0 AWG to about 600 kcmil line wire conductors. Like the load bus connector assembly 212 previously described, stops 421S, 422S may be provided on the first and second line sliding nuts 425, 427 to limit an extent of travel into the first and second line slide features 421, 422.

The connector body 455 may include a first body portion 460 and a second body portion 462 extending from the first body portion 460 on a side opposite a line wire conductor entry side. A height of the second body portion 462 is thinner than a height of the first body portion 460. Second body portion 462 may include a same thickness throughout, and may include a planar upper surface. Line bus connector assembly 214 includes stationary contacts 440A-440C (otherwise referred to herein as "line-side stationary contacts") attached to an upper side of the second body portion 462, such as by fasteners 434 (e.g., bolts or screws or the like).

Other fastening methods may be used. Stationary contacts 440A-440C may be made of a copper material, may be bent in an L-shape, and may include pointed tips thereon, as shown.

In some embodiments, an outer contour configuration of the first body portion 460 and the second body portion 462 of the line bus connector assembly 214 may be extruded. Thus, an extruded component including the structure and contours of the first and second body portions 460, 462 may be formed in the extrusion direction 455E. The extrusion may be cut to the overall width of the line bus connector assembly 214, and then machined to form the final features of the first and second body portions 460, 462, including forming of the first and second line lugs 416, 418, first and second line slide features 421, 422 for the first and second line sliding nuts 425, 427, the first hole 457A and second hole 457B and threaded bores that receive the fasteners 434. This manufacturing process may result in substantially reduced material and manufacturing cost.

Line Base Switch Assembly

FIG. 5 illustrates a partially-exploded, perspective view of a non-fusible switch assembly 500 provided in accordance with one or more embodiments. Non-fusible switch assembly 500 includes a line base assembly 200. Line base assembly 200 includes the base 202, a line bus connector assembly 214 (as previously described) coupled to the base 202 on one end, and a load bus connector assembly 212 (as previously described) coupled to the base 202 on another end. Non-fusible switch assembly 500 may also include a rotor assembly 215 that is mounted for rotation relative to the base 202. Coupling attachment of the non-fusible switch assembly 500 to the enclosure 711 (See FIG. 7) may be made via connection features 202C of the base 202, such as two or more tabs shown that receive fasteners (not shown). Other numbers or types of connection features 202C may be used.

Figure 7:
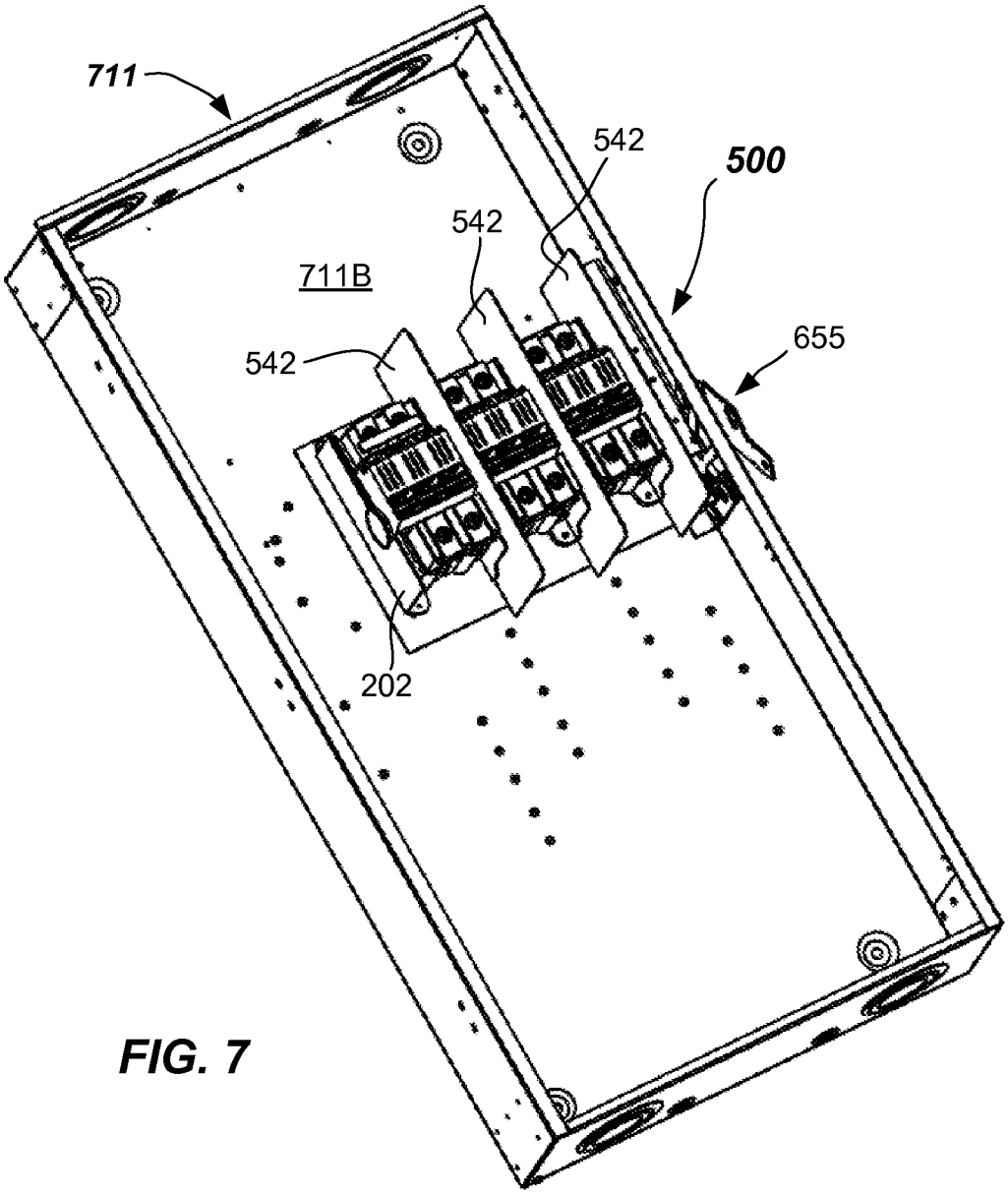
FIG. 7 illustrates a perspective view of a non-fusible switch assembly installed within an enclosure (with cover removed) according to embodiments.

Base 202 may include two or more barriers 542 that separate the poles of the non-fusible switch assembly 500 from one another. Barriers 542 may be planar sheets of insulating material (e.g., thermoplastic such as the polyester material described above) that may be received and secured into slots 202S (the left-most of the slot 202S shown without a barrier 542). Slots 202S may be formed in the sides and/or top of a molded body of the base 202. In the depicted embodiment, the barriers 542 are shown separating poles and, in addition, a barrier 542 is provided on one end only to provide separation from the rotation mechanism 655 (FIG. 7). Any suitable combination of barriers 542 may be used.

Again referring to FIG. 5, the non-fusible switch assembly 500 may include 3 poles in some embodiments, namely first pole 544, second pole 546, and third pole 548. Each of these first, second, and third poles 544, 546, 548 may include the load bus connector assembly 212 and the line bus connector assembly 214, as previously described herein. However, not all poles may be used. For example, a 2-pole version may not use the second pole 546, and may only include a load bus connector assembly 212 and line bus connector assembly 214 at the first pole 544 and the third pole 548. Furthermore, less than three stationary contacts may be included in each load bus connector assembly 212 and line bus connector assembly 214. For example, in a 2-pole, 400 Amp version of a non-fusible switch assembly, only the two outer poles (e.g., first pole 544, and third pole 548) would be used, and only two of the load-side stationary contacts 340A, 340B and only two of the line-side stationary contacts 440A, 440B may be used, with the other stationary contact 340C, 440C being inoperative or eliminated. Other configurations are possible.

Figure 6:
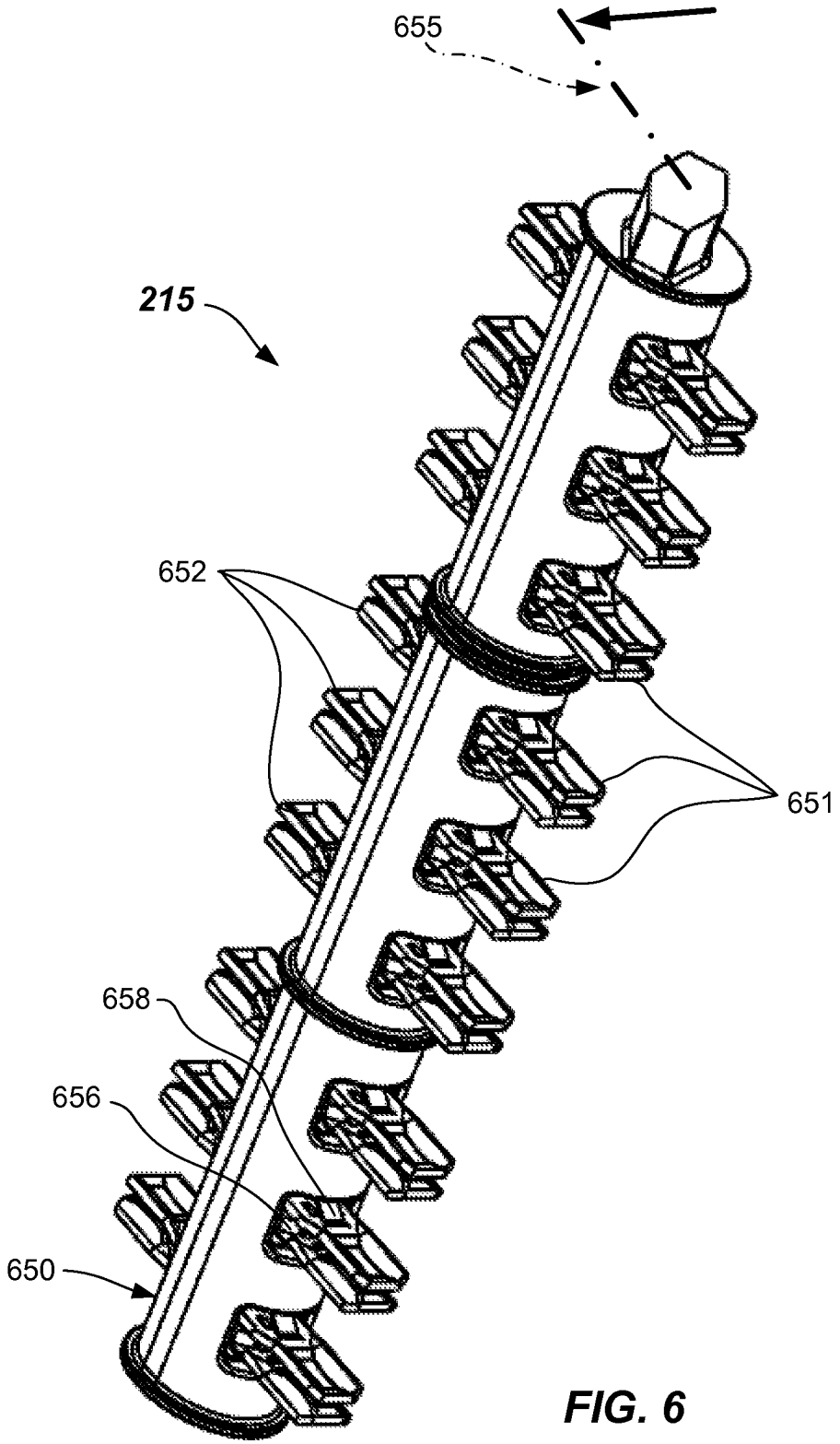
FIG. 6 illustrates a perspective view of a rotor assembly of a non-fusible switch assembly according to embodiments.

FIG. 6 illustrates a perspective view of an example of a rotor assembly 215 that may be used in the non-fusible switch assembly 500 and the line base assembly 200. Rotor assembly 215 includes a rotor body 650 and coupled first blades 651 (e.g., load-side blades) and second blades 652 (e.g., line-side blades). First blades 651 (e.g., load-side blades) are configured to electrically connect to the stationary contacts 340A-340C (e.g., load-side stationary contacts 340A-340C) of the load bus connector assembly 212. Second blades 652 (e.g., line-side blades) are configured to electrically connect to the stationary contacts 440A-440C (e.g., line-side stationary contacts 440A-440C) of the line bus connector assembly 214. Rotor assembly 215 is mounted for rotation relative to the base 202 and the rotor assembly 215 and first and second blades 651, 652 may be rotated by a suitable rotation mechanism (e.g., rotation mechanism 655). Rotation mechanism 655 may be a lever and cable mechanism coupled to and configured to rotate the rotor assembly 215 via operation of a user. Rotation mechanism 655 may be mounted to an enclosure (e.g., enclosure 711 of FIG. 7) including the non-fusible switch assembly 500. Rotation mechanism 655 may be used to open and close the non-fusible switch assembly 500.

Each of the first and second blades 651, 652 of the rotor assembly 215 may include blade spacers 656 located in between the individual pairs of blades 651, 652 to keep them spaced apart, as desired. Blade spacers 656 may be annular rings, for example. Blade springs 658 may be used to apply a force to ensure proper electrical contact when the rotor assembly 215 is rotated to make contact with, and receive, the stationary contacts 340A-340C of the load bus connector assembly 212 between the first blades 651, and the stationary contacts 440A-440C of the line bus connector assembly 214 between the second blades 652. Other suitable constructions of the rotor assembly 215 may be used. Some or the blades 651, 652 may be omitted in 400 Amp versions, as well as in 2-pole versions of the non-fusible switch assembly.

First and second blades 651, 652 of the rotor assembly 215 may be rotated via the rotation mechanism 655 to couple and electrically connect the first blades 651 to the stationary contacts (e.g. 340A-340C) of the load bus connector assembly 212 and the second blades 652 to the stationary contacts (e.g. 440A-440C) of the line bus connector assembly 214. Arc grids 224 may be provided proximate to each stationary contact 340A-340C, 440A-440C and function to minimize arcing (FIG. 5).

FIG. 7 illustrates a non-fusible switch assembly 500 as described above. The non-fusible switch assembly 500 may be operated via the rotation mechanism 655, which may be of conventional construction. Non-fusible switch assembly 500 may be included in a suitable enclosure 711, such as the switch box enclosure shown (with cover removed). Line conductor wires (not shown) may enter through knockouts in the top, and load wire conductors (not shown) may exit through knockouts in the bottom, for example. Other components may be provided in the enclosure 711 and additional barriers 542 may be added in such embodiments. Non-fusible switch assembly 500 may include a base 202 configured to couple to a portion (e.g., a back wall portion 711B) of the enclosure 711. A suitable NEMA enclosure may be used, such as a NEMA 1 or NEMA 12 enclosure for Indoor use, or NEMA 3R or NEMA 4X enclosure for outdoor use, for example.

Figure 8:
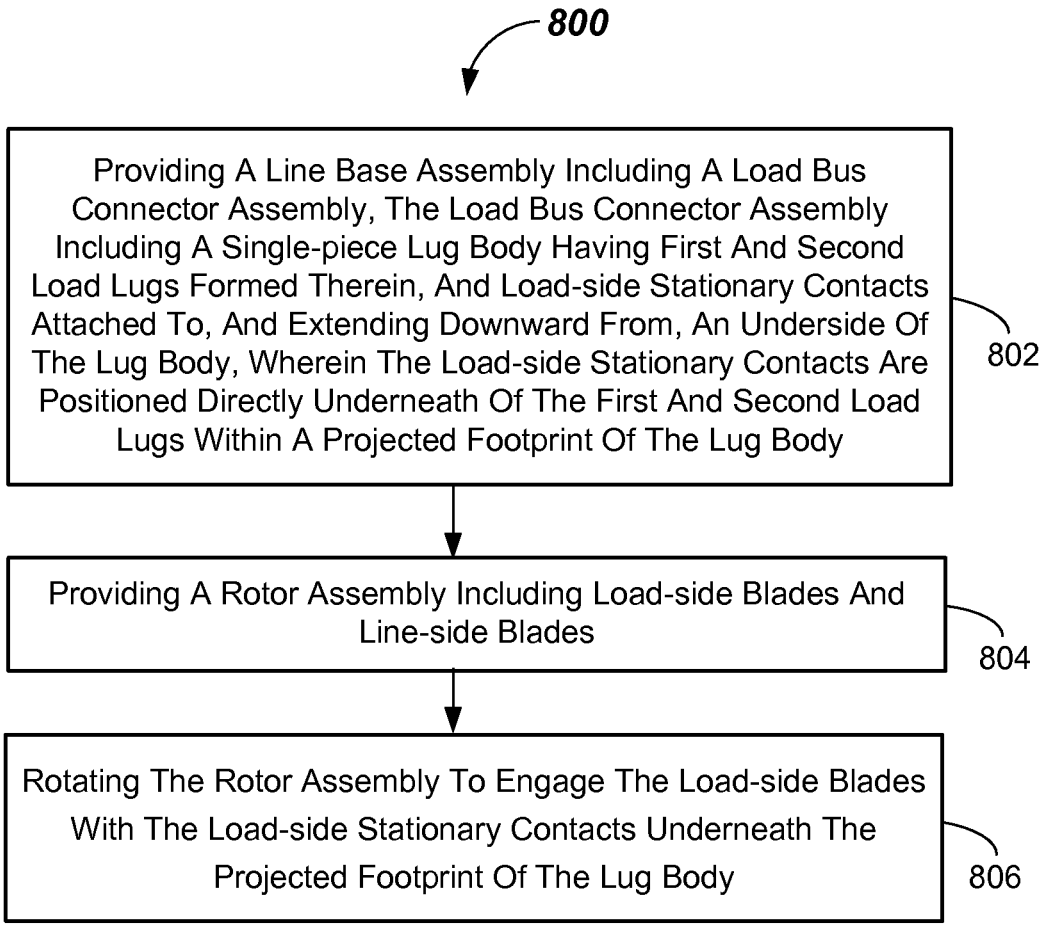
FIG. 8 illustrates a flowchart of a method of operating a non-fusible switch assembly according to embodiments.

FIG. 8 illustrates a method operating a line base assembly (e.g., line base assembly 200), in accordance with some embodiments of the invention. Line base assembly (e.g., line base assembly 200) may be included in a non-fusible switch assembly (e.g., non-fusible switch assembly 500).

Method 800 includes, at 802, providing a line base assembly (e.g., line base assembly 200) including a load bus connector assembly (e.g., load bus connector assembly 212), the load bus connector assembly including a single-piece lug body (e.g., lug body 326) having first and second load lugs (e.g., first and second lugs 316, 318) formed therein, and load-side stationary contacts (e.g., load-side stationary contacts 340A-340C, or combinations thereof) attached to, and extending downward from, an underside (e.g., underside 326U) of the lug body, wherein the load-side stationary contacts are positioned directly underneath of the first and second load lugs within a projected footprint of the lug body. Projected footprint is defined by projection of the outside periphery of the underside away from the underside 326U. Load-side stationary contacts may be centered or slightly offset on the projected footprint of the lug body.

The method 800 includes, in 804, providing a rotor assembly (e.g., rotor assembly 215) including load-side blades (e.g. blades 651) and line-side blades (e.g. blades 652), and in 806, rotating the rotor assembly to engage the load-side blades with the load-side stationary contacts (e.g., load-side stationary contacts 340A-340C or combinations thereof) underneath the projected footprint of the lug body. At the same time, the method 800 may include rotating the rotor assembly (e.g., rotor assembly 215) to engage the line-side blades (e.g. blades 652) with line-side stationary contacts (e.g. line-side stationary contacts 440A-440C or combinations thereof), of a line bus connector assembly (e.g., line bus connector assembly 214).

It should be readily appreciated by those persons skilled in the art that the invention is susceptible of broad utility and application. Many embodiments and adaptations of the invention other than those described herein, as well as many variations, modifications, and equivalent arrangements, will be apparent from, or reasonably suggested by, the invention and the foregoing description thereof, without departing from the substance or scope of the present invention. Accordingly, while the invention has been described herein in detail in relation to specific embodiments, it is to be understood that this disclosure is only illustrative and presents examples of the invention and is made merely for purposes of providing a full and enabling disclosure of the invention. This disclosure is not intended to limit the invention to the particular devices, systems or methods disclosed, but, to the contrary, the intention is to cover all modifications, equivalents, and alternatives falling within the scope of the invention.

What is claimed is:

1. A line base assembly, comprising:

a base;

a line bus connector assembly coupled to the base, the line bus connector assembly including:

a connector body including a first body portion and a second body portion extending from the first body portion and being thinner than first body portion, wherein the connector body is a single piece, first and second line lugs formed in the first body portion, and first and second line slide features formed in the connector body, first and second line-side sliding nuts configured to be received in the first and second line slide features, and line-side stationary contacts coupled to the second body portion; and a load bus connector assembly coupled to the base, the load bus connector assembly including:

a lug body including a front side, a back side, and an underside, wherein the lug body is a single piece, first and second load lugs formed in the lug body, and first and second load slide features formed in the lug body, first and second load-side sliding nuts configured to be received in the first and second load slide features, and load-side stationary contacts attached to, and extending downward from, the underside of the lug body, and wherein the load-side stationary contacts are positioned directly underneath of the first and second load lugs within a projected footprint of the lug body.

2. A line base switch assembly including the line base assembly of claim 1 and a rotor assembly including blades mounted for rotation relative to the base, wherein the blades are configured to electrically connect to the line-side stationary contacts and the load-side stationary contacts.

3. A line base assembly of claim 1 comprising an arc shield covering the line-side stationary contacts.

4. A non-fusible switch assembly, comprising:

a line base assembly including:

a base;

a line bus connector assembly coupled to the base, wherein the line bus connector assembly comprises:

a connector body including a first body portion and a second body portion extending from the first body portion and being thinner than first body portion, wherein the lug body is a single piece, first and second line lugs formed in the first body portion, and first and second line-side slide features formed in the connector body, first and second line-side sliding nuts configured to be received in the first and second line-side slide features, and line-side stationary contacts coupled to the second body portion;

a load bus connector assembly coupled to the base, the load bus connector assembly including:

a lug body including a front side, a back side, and an underside, wherein the lug body is a single piece, first and second load lugs formed in the lug body, and first and second load slide features formed in the lug body, first and second load-side sliding nuts configured to be received in the first and second load slide features, and load-side stationary contacts attached to, and extending downward from, the underside of the lug body, and wherein the load-side stationary contacts are positioned directly underneath of the first and second load lugs within a projected footprint of the lug body; and a rotor assembly including blades adapted to electrically couple to line-side stationary contacts and the load-side stationary contacts.

5. The non-fusible switch assembly of claim 4, wherein an outside contour configuration, the first and second load lugs, and the first and second load slide features of the load bus connector assembly are extruded.

6. The non-fusible switch assembly of claim 4, wherein the front side and the back side of the lug body comprise machined planar surfaces.

7. The non-fusible switch assembly of claim 4, comprising one or more stops provided on the first and second load-side sliding nuts.

8. The non-fusible switch assembly of claim 4, wherein the lug body includes a first flange and a second flange extending in opposite directions.

9. The non-fusible switch assembly of claim 8, comprising registration features provided on the first flange and the second flange that are configured to register with features provided on the base.

10. A line bus connector assembly for use with a base, the line bus connector assembly including:

a connector body including a first body portion and a second body portion extending from the first body portion and being thinner than first body portion, wherein the connector body is a single piece, first and second line lugs formed in the first body portion, and first and second line slide features formed in the connector body, first and second line-side sliding nuts configured to be received in the first and second line slide features, and line-side stationary contacts coupled to the second body portion.

11. The line bus connector assembly of claim 10, further comprising:

an outer contour configuration of the first body portion and the second body portion of the line bus connector assembly that is extruded.

12. The line bus connector assembly of claim 10, further comprising:

an extruded component including a structure and contours of the first body portion and the second body portion that is formed in an extrusion direction.

* * * * *